US006019643A

United States Patent [19]

Barrat et al.

[11] Patent Number: 6,019,643

[45] Date of Patent: Feb. 1, 2000

[54] CONNECTION MODULE HAVING CONNECTION TERMINALS THAT ARE INTERCONNECTABLE VIA AT LEAST ONE MOVING CONDUCTIVE PIECE

[75] Inventors: Sylvain Barrat; Francois Fayard, both of Villeurbanne; Bernard Bechaz, Caluire, all of France

[73] Assignee: Entrelac S.A., Villeurbanne, France

[21] Appl. No.: 08/990,640

[22] Filed: Dec. 15, 1997

[30] Foreign Application Priority Data

Dec. 16, 1996 [FR] France ..... 96 15414

[51] Int. Cl.[7] ..... H01R 9/26

[52] U.S. Cl. ..... 439/716; 439/709

[58] Field of Search ..... 439/716, 709, 439/712

[56] References Cited

U.S. PATENT DOCUMENTS

| | | | |
|---|---|---|---|
| 5,658,172 | 8/1997 | Schmidt et al. | 439/716 |
| 5,848,917 | 12/1998 | Bechaz et al. | 439/716 |

FOREIGN PATENT DOCUMENTS

| | | |
|---|---|---|
| 0386277 | 9/1990 | European Pat. Off. . |
| 2483692 | 5/1980 | France . |
| 2357080 | 1/1988 | France . |
| 1924454 | 9/1965 | Germany . |
| 2601849 | 7/1977 | Germany . |

*Primary Examiner*—Paula Bradley
*Assistant Examiner*—Tho Dac Ta
*Attorney, Agent, or Firm*—Ware, Fressola, Van Der Sluys & Adolphson LLP

[57] ABSTRACT

A connection module, in particular a junction block, having connection terminals that are interconnectable by means of moving conductive pieces that can be driven from outside the module. A box of insulating material contains the connection terminals and respective electric link strips for each module, which strips are fixed and terminate in individual extensions serving as contact elements, said extensions extending parallel to a common plane inside the box, with elements on any one level being in alignment. A conductive piece includes at least one comb of parallel spring-blade contact clips enabling it to come into contact with the extensions on a given level by the clips coming astride them when a drive member carrying the clips is moved inside the box from outside the box where said drive member has a handle-forming head.

9 Claims, 5 Drawing Sheets

Fig. 1.

Fig. 2.

Fig. 3.

CONNECTION MODULE HAVING CONNECTION TERMINALS THAT ARE INTERCONNECTABLE VIA AT LEAST ONE MOVING CONDUCTIVE PIECE

TECHNICAL FIELD

The invention relates to a connection module, in particular a module of the junction block type, and that includes connection terminals which are interconnectable by means of moving conductive pieces received inside the module and capable of being driven from outside the module.

BACKGROUND OF THE INVENTION

As has been known for a long time, and as can be seen in particular from document FR-A-2 357 080, interconnections are made between the electrical conductors serving various electrical appliances by means of modules, in particular such as junction blocks. For this purpose, the modules include connection terminals, e.g. of the wire-clamping screw type, received in boxes where they are selectively interconnected by conductive strips, and in which they are accessible to conductors from the outside. The boxes are generally flat and of small thickness, and they are made of insulating material. Insertion openings are provided facing the connection terminals through some of the walls of each box so as to allow electrical conductors to be inserted for connection to the terminals. Other openings are also provided for passing a terminal-driving tool, such as a screwdriver for a terminal having a screw to clamp a wire.

Such connection modules are generally intended for mounting side by side in alignment with other modules that are identical or comparable, on a support which is conventionally a standardized rail, with each module being positioned transversely relative to the rail and being fixed thereto in predetermined manner by a base that carries positioning and fixing members for this purpose. Modules in alignment on a common support are placed side by side via their respective side faces of large dimensions. The openings are thus usually made through the remaining faces which are of smaller size, and referred to herein as "edge" faces. The openings for the driving tool are preferably provided in a wall or wall portion of the box situated opposite its base and thus highly accessible when the modules are mounted on a support, while the conductor-insertion openings are made in the remaining wall portions situated between the large side faces, the base, and the wall or wall portions opposite said base.

It has also been known for a long time, as can be seen for example in document FR-A-2 483 692, to provide modules such as junction blocks with switches to make it possible, in controlled manner, to electrically interconnect or disconnect strips that are situated in alignment within the same module.

As already mentioned in that prior document, junction blocks were already in existence having switches of the knife-blade type or of the sliding plug type, and it is stated that such switches require their contact pieces to be positioned very accurately and that a safety device was necessary to make positioning thereof reliable. To remedy those drawbacks, the above-mentioned document proposes a device enabling operation to be performed easily and quickly, with effective clamping and reliable positioning; nevertheless, implementation of that device is not without difficulty.

OBJECTS AND SUMMARY OF THE INVENTION

The present invention is concerned with the same requirements as those mentioned above, and it seeks to provide a solution which is simple to produce, simple to assemble during manufacture, and simple to install and optionally to modify, should that be necessary, when completed modules are being installed or altered.

The invention thus provides a connection module, in particular a junction block, comprising a box of insulating material containing connection terminals for electrical conductors that reach the terminals inside the box via insertion orifices formed through the walls of the box, individual electric link strips for the terminals, said strips being stationary and extending towards a central portion of the box where each of them is terminated by an extension serving as a contact element, the extensions of two strips situated at the same level in the box, and being suitable for being interconnected by means of a conductive piece carried by a drive member operatable from outside the box, when said drive member is moved to slide inside the box to a position where the above-mentioned extensions of two strips at the same level are individually engaged by respective spring-blade clips of the conductive piece.

According to a characteristic of the invention, said module includes at least one plane conductive piece having parallel spring-blade clips disposed in a comb, and strip extensions that are folded to extend parallel to a common transverse midplane of the box, with extensions at the same level extending in the same direction so as to enable them to co-operate with the clips of a conductive piece, each clip engaging a respective extension by coming astride it transversely and axially in a longitudinal midplane of the extension.

BRIEF DESCRIPTION OF THE DRAWINGS

The invention, its characteristics, and advantages, are described in greater detail below with reference to the accompanying drawings, in which.

BEST MODE FOR CARRYING OUT THE INVENTION

Figure 1:
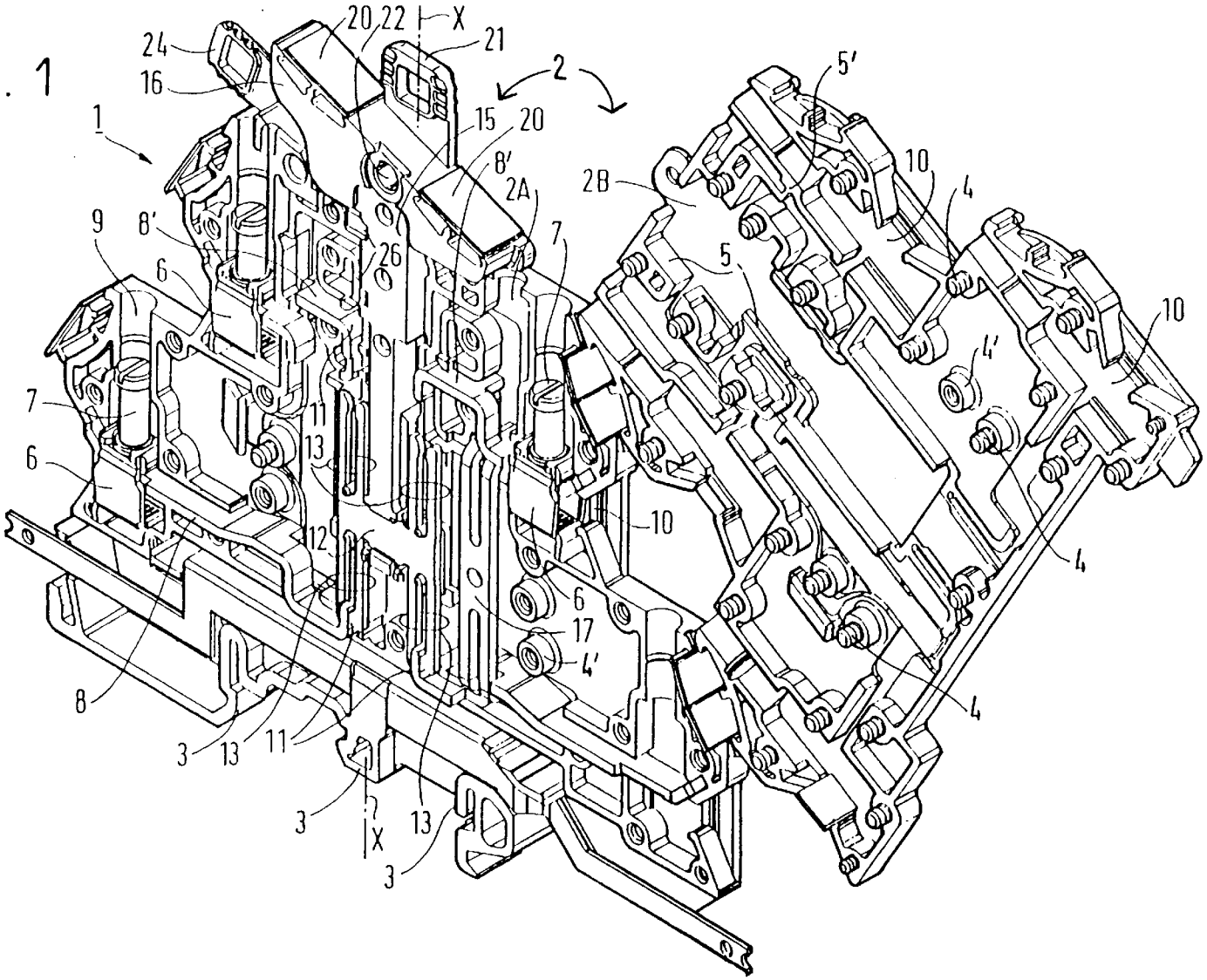
FIG. 1 is a perspective view of one example of a connection module of the invention of the junction block type, having a single switch, and having its box made up of two hinged-together portions that can be placed side by side, and that are shown in the open position in this figure.

The connection module 1 for electrical conductors shown in FIG. 1 is, for example, of the junction block type, as shown. It comprises a box 2 that is flat and of small thickness, being made of an insulating material in the form of two portions 2A and 2B that are obtained simultaneously by molding so as to be hinged to each other via an edge, thereby forming two half-shells that are placed side by side by folding one down on the other to define a volume whose walls are organized to enable it to receive various electrical components that may be stationary or moving to a greater or lesser extent. The connection module 1 is assumed in this case to be designed so as to be suitable for association with a plurality of modules that are identical or similar and that are grouped on a common support (not shown) which is conventionally a rail of standardized shape for a connection module of the junction block type. Each connection module can then have a fixing leg such as the leg 3 of conventional three-element type, as shown in FIG. 1. The fixing leg is located on a portion of the box which serves as a base. Modules that are compatible, and thus usually identical or similar, and suitable for mounting side by side on a common support generally have two large side faces each for placing against the side faces of two other modules on either side of the module in question when the modules are in alignment on a common support. In the example shown in FIG. 1, the two large side faces (not shown) of the connection module shown respectively form portions of the two different box portions 2A and 2B of said module, each being constituted by the outside face of a wall whose inside face carries integrally molded elements in relief for the purpose of holding and/or guiding components received in the box of the connection module 1, such as pegs 4 and holes 4' for receiving pegs, and guide elements 5 or holding elements 5' that can be seen on portion 2B in FIG. 1.

In conventional manner, the connection module has connection terminals for electrical conductors, which terminals may optionally be spring terminals or terminals having an insulation-piercing blade, but are assumed in the embodiments described with reference to FIG. 1 to be screw-type terminals. In this example, which must not be considered as being limiting, each screw connection terminal is assumed to comprise a metal cage 6 mounted to slide in a housing formed in at least one of the two portions 2A and 2B of the connection module box, and by a screw 7 capable of being screwed into the cage 6 to move it relative to an end of a longitudinal metal electrical link strip 8 or 8' which is fixed and which penetrates into the cage, and against which the end of the screw remote from its head bears. In conventional manner, tightening the screw 7 causes the screw to bear against the link strip 8 or 8' which is held by appropriate relief formed on the inside face of at least one of the two box portions 2A, 2B, thereby moving the cage relative to the strip of the terminal as soon as the screw engages the strip. This continues until the strip comes into contact with the inside wall of the cage opposite from its wall through which the screw passes, or else until a conductor, such as a wire or a rod, is clamped between the cage and the strip. The screws 7 are located so as to be driveable from outside the module, with their respective heads being accessible via individual ducts 9 opening to the outside of the box, preferably through the edge thereof that is remote from its base so as to make it easier to drive the screw. Insertion orifices 10 for electrical conductors are provided in the edge walls of the box in the vicinity of each terminal in the wall formed at this level by one and/or the other of the two box portions 2A, 2B to enable and facilitate positioning of an electrical conductor prior to actual connection by clamping the screw 7 in a terminal, these orifices being defined by wall elements of one or both of the portions 2A and 2B, which elements form a guide funnel, as can be seen in FIGS. 1 and 2.

Figure 2:
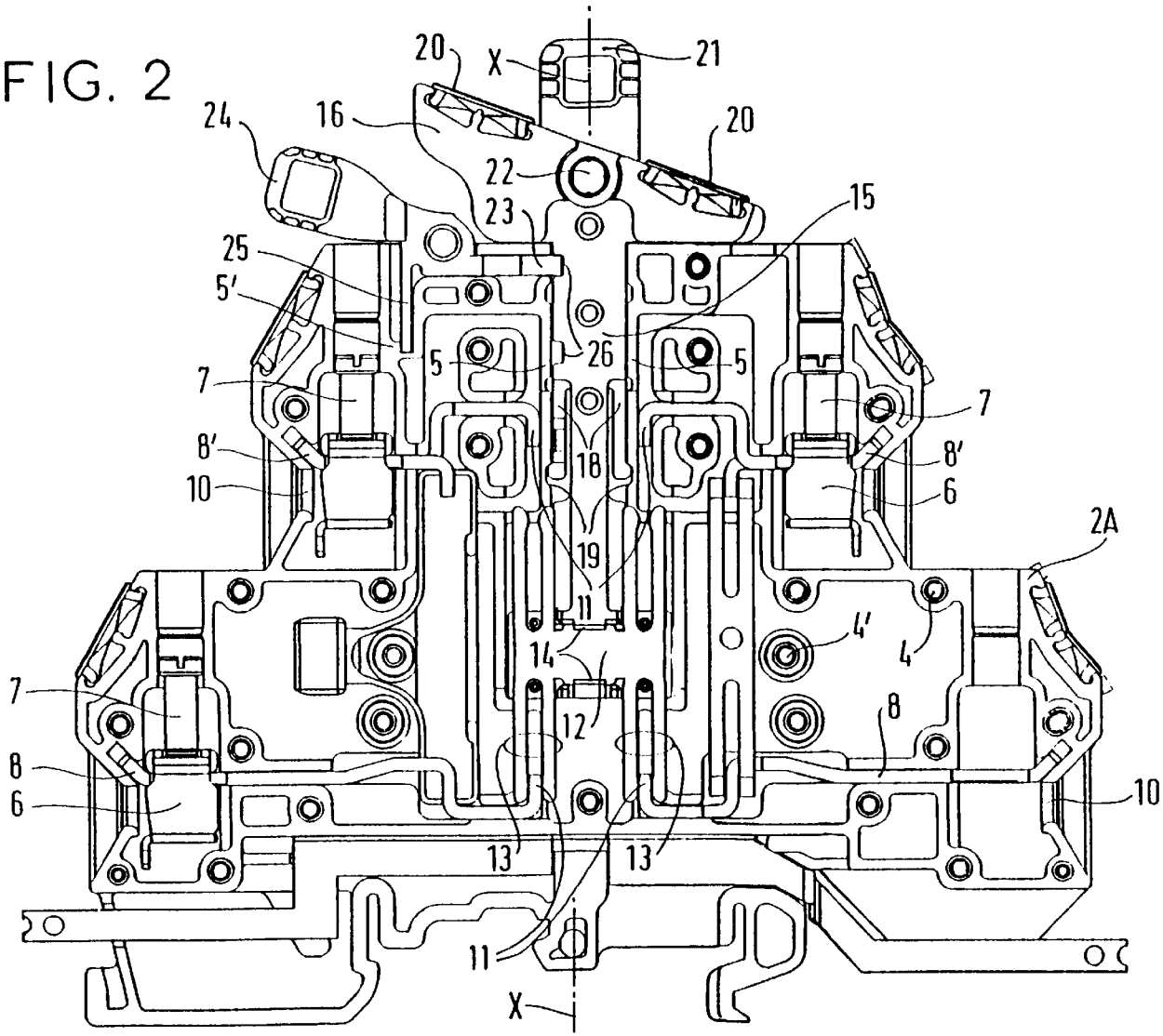
FIG. 2 is a side view of one of the two portions of the connection module of FIG. 1.

In a disposition which is common in the intended application, the appearance of the connection module is at least approximately symmetrical about a transverse midplane represented by line XX in FIGS. 1 and 2. The connection terminals have their insertion orifices 10 disposed, symmetrically in this case, over the two opposite edge faces of the connection module box that extend between the two large faces and also between the base and the wall of the box that is remote from the base. In the example shown, these terminals are distributed over two levels relative to the base of the box. Each terminal is associated with an individual link strip 8 or 8', referred to as a terminal electric link strip and obtained, for example, by being cut out from sheet material that has a section which is at least approximately rectangular in appearance, for example. Each terminal link strip is held in the box as mentioned above and it extends towards the central portion of the box where it is terminated by an extension 11 serving as a contact element and obtained by transverse folding. The extension is folded so as to extend parallel to a transverse plane of the box which, in the embodiment described, is a central plane of symmetry, which plane is designed to be perpendicular to the support when the box is fixed on the support, which is assumed in this case to be in the form of a rectilinear rail. In the invention, the individual link strips 8 or 8' of the controllably interconnectable connection terminals are disposed in the box in such a manner that the extensions 11 of these strips serving as contact elements are disposed in pairs on a common level and in the same orientation, at least on each level.

In the non-limiting example shown in FIG. 1, the two link strips 8 are situated at a first level close to the base. Their respective extensions 11 are parallel and symmetrically disposed on either side of a plane which is preferably the transverse midplane of the connection module 1 as represented in this case by line XX. The free ends of these extensions are further from the base than are the folds at their respective opposite ends. However, the extensions of the two link strips 8' situated at a second level, further away from the base than the first level, are similarly parallel and symmetrical, but their free ends are closer to the base than the folds at their opposite ends.

The extensions serving as contact elements for the terminal electric link strips of a module are preferably aligned on any one level, and between levels within the same housing containing them, and they point in the same direction, at least on each level having a pair of them.

In the invention, two link strips 8 or 8' having their respective extensions 11 situated on the same level and in the same orientation are put into connection by means of a moving conductive piece 12 which is preferably a plane piece of metal, having at least one comb with two parallel contact clips 13, each clip being made up in conventional manner of two parallel spring blades whose free ends are formed so as to clamp resiliently onto an extension about which they are placed astride.

Naturally, a comb of a conductive piece could be provided with more than two clips in parallel, if the number of extensions in alignment on a given level is greater than two. It is also possible to envisage providing a comb with parallel clips for connecting to extensions which are only approximately at the same level, e.g. so that one of the extensions is engaged before one or two others during displacement.

In a preferred embodiment, each clip is symmetrical in appearance and at least approximately plane, and it lies in a longitudinal plane that is preferably in the middle or nearly in the middle of at least the extension 11, and better of the strip carrying the extension. Each clip preferably connects to the extension to which it comes into contact by being placed astride it transversely and axially as can be seen in FIG. 1, in particular. This makes it possible in particular to avoid the clip having to withstand any forces that might arise during tightening or loosening of the screw of the terminal and which could be transferred via the strip, if the strip serves a screw-type connection terminal, as shown in the figures.

Figure 3:
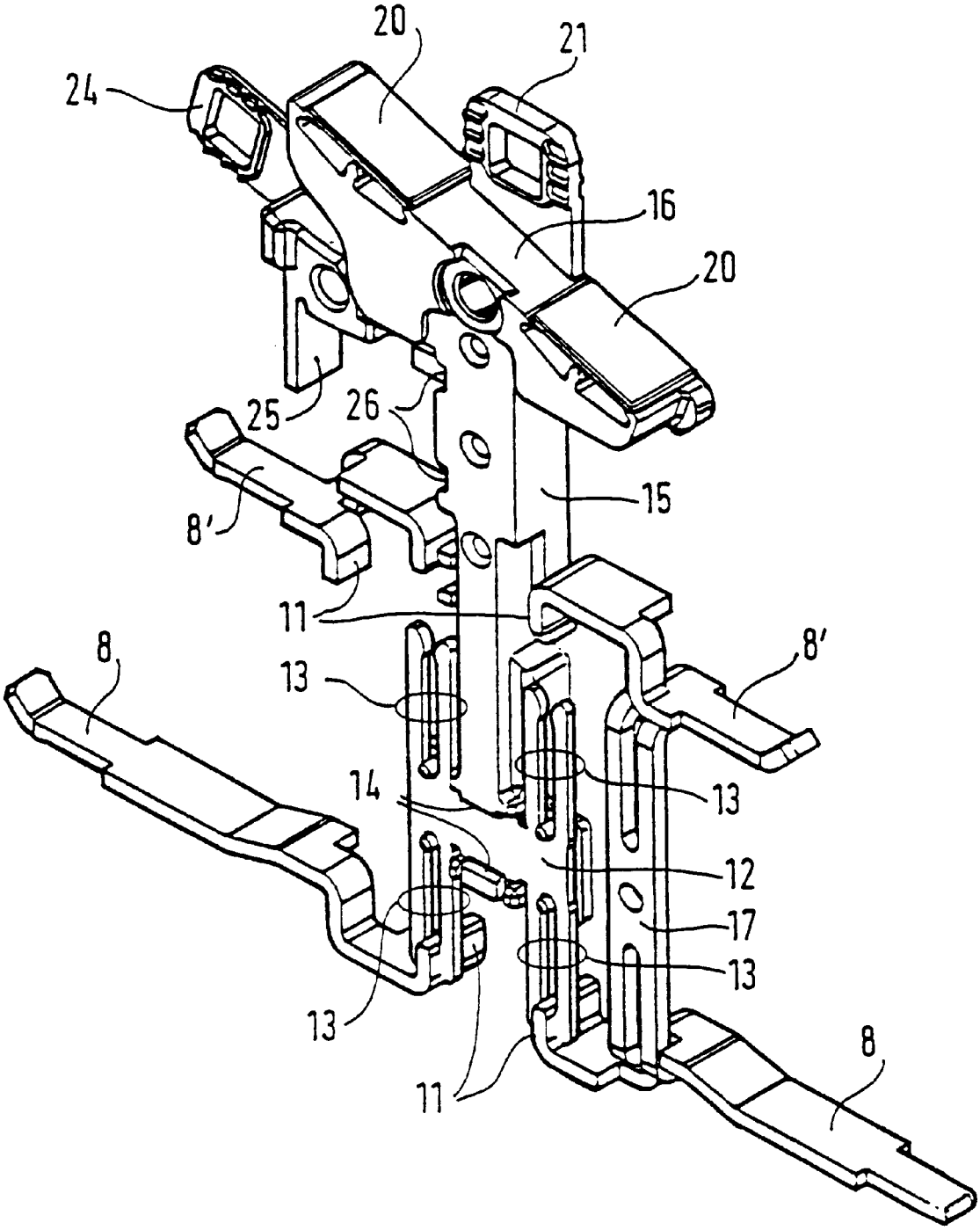
FIG. 3 is a perspective view of one example of the switch device having a single control for the connection module of FIGS. 1 and 2, together with the link strips for the wire-connection terminals with which the device co-operates.

In an embodiment, and as shown in FIGS. 1 to 3, the moving conductive piece 12 is made by being cut out from a plane blank, and it has two combs each comprising two parallel contact clips 13 in its initial shape, with the two combs being mounted back to back and either being maintained assembled together as shown in FIG. 1, or else being dissociated so as to constitute two identical moving conductive half-pieces, for a purpose that is explained in greater detail below.

In the invention, the moving conductive piece 12 having two combs mounted back to back in symmetrical manner, as described above, is fixed to a positioning arrangement 14 by any appropriate means, e.g. by rivets, snap-fastening, and/or other means to a drive member 15 which is moveably mounted in the connection module box and which is designed to be driven from outside said box.

In a preferred embodiment, the drive member 15 is made of insulating material and includes a portion forming a slide rod which is received between fixed guide elements 5 carried on the inside face of at least one of the portions 2A and 2B when these portions are side by side to form a closed box.

The rod of the drive member 15 is provided with a handle-forming head 16 which is designed to remain projecting out from the box in all positions that can be reached by causing the moving conductive piece 12 to be slid by means of the drive member 15.

In the embodiment shown in FIGS. 1 to 3, the free ends of the extensions 11 which are situated in pairs either on the first level or on the second level in a box are spaced apart by a distance which is greater than the length of the moving conductive piece 12. This piece comprises two combs whose clips are disposed symmetrically about a transverse mid-plane. These combs are mounted back to back so that the clips carried by one of the combs are in place astride the facing strip extensions on one level while the clips of the other comb of said piece are at a distance from the free ends of the strip extensions on the other level, with the gap being large enough to ensure that an electrical connection cannot be established through the air in the gap, providing the maximum acceptable voltage is not exceeded.

Sliding the moving conductive piece 12 from one level to the other, i.e. from a first position to a second position serves to establish either an electrical connection between the extensions 11 of the strips on the first level, or else between the extensions 11 of the strips on the second level, and thus between the connection terminals mounted on those strips.

A link established by a conductive shunt piece 17 connected to two strips at different levels and received in the same half of the box serves to establish a changeover switch enabling a terminal mounted on one of the two strips to be electrically connected alternately with one or the other of the two terminals received on the strips situated in the other half of the box on the two different levels thereof.

As already mentioned, the drive member 15 has a portion forming a sliding rod with its end remote from its head 16 carrying the positioning arrangement 14 of the moving conductive piece 12, which arrangement may have a central portion snapped between the edges of a notch-type housing formed to receive it at said end. The sliding rod may be of rectangular cross-section and it is guided between guide elements 5 which define a sliding groove, which elements are carried on the inside face of at least one of the portions 2A and 2B, with the groove being formed when said portions are side by side to constitute a closed box, as mentioned above.

In the embodiment described, guidance is provided via a portion of the sliding rod which is situated in the vicinity of its head 16. Its end carrying the positioning arrangement 14 is connected to the head end via a portion where the rod is of reduced thickness so as to receive a resilient retention element constituted in this case by two resilient positioning tabs 18 formed on either side of the rod from which they project to rub against the guide elements 5 while the rod is sliding. The retention element is designed to co-operate with a complementary element of the box, implemented in this case by notches 19 formed in the guide elements defining the guide groove. These notches co-operate with the free ends of the resilient positioning tabs 18 so as to enable the drive member 15 to be resiliently retained in at least one predetermined position until sufficient predetermined force is applied to the drive member via the head 16. This has the effect of causing the member to move suddenly from one position to the other, as is commonly required in switching applications. Sudden displacement from one position to the other also has the effect of avoiding the drive member taking up an intermediate position between the two design positions therefor, assuming that such an intermediate position is not desired.

In the embodiment shown, the head 16 is asymmetrical so that label carriers 20 provided thereon are tilted in easily readable manner when the module is in place on the support carrying the module in an installation.

A pull tab 21 projects from the head 16 in the opposite direction to the sliding rod. The tab has an opening in which a tool can be engaged, e.g. the shank of a screwdriver, for the purpose of moving the drive member 15 and the moving conductive piece 12 by sliding between the positions provided for them in the connection module.

The head 16 also has a duct 22 passing through it to receive a rod for mechanically interconnecting the heads of identical or similar connection modules mounted side by side in alignment on a common support, so as to make it possible to control the heads and thus the moving conductive pieces 12 in all of the modules simultaneously.

In the embodiment shown in FIGS. 1 to 3, a device is provided for locking the sliding rod in position, which device comprises a piece made up of a bolt-forming element 23 and a pull tab 24 carried by a resilient tab 25 which is hinged in a groove formed in at least one holding element 5' on the inside face of one or both of the portions 2A and 2B. The end of the bolt 23 is designed to engage resiliently in a notch 26 formed in the portion of the sliding rod situated close to the head 16, with the positions of the notches corresponding to predetermined positions for the moving conductive piece 12 relative to the extensions 11 of the strips. The drive member 15 is released for sliding by pulling the pull tab 24 in the direction determined by the oblique orientation of said pull tab, thereby bending the resilient tab 25 and causing the bolt 23 to come out of the notch 26 in which it was previously received.

Figure 4:
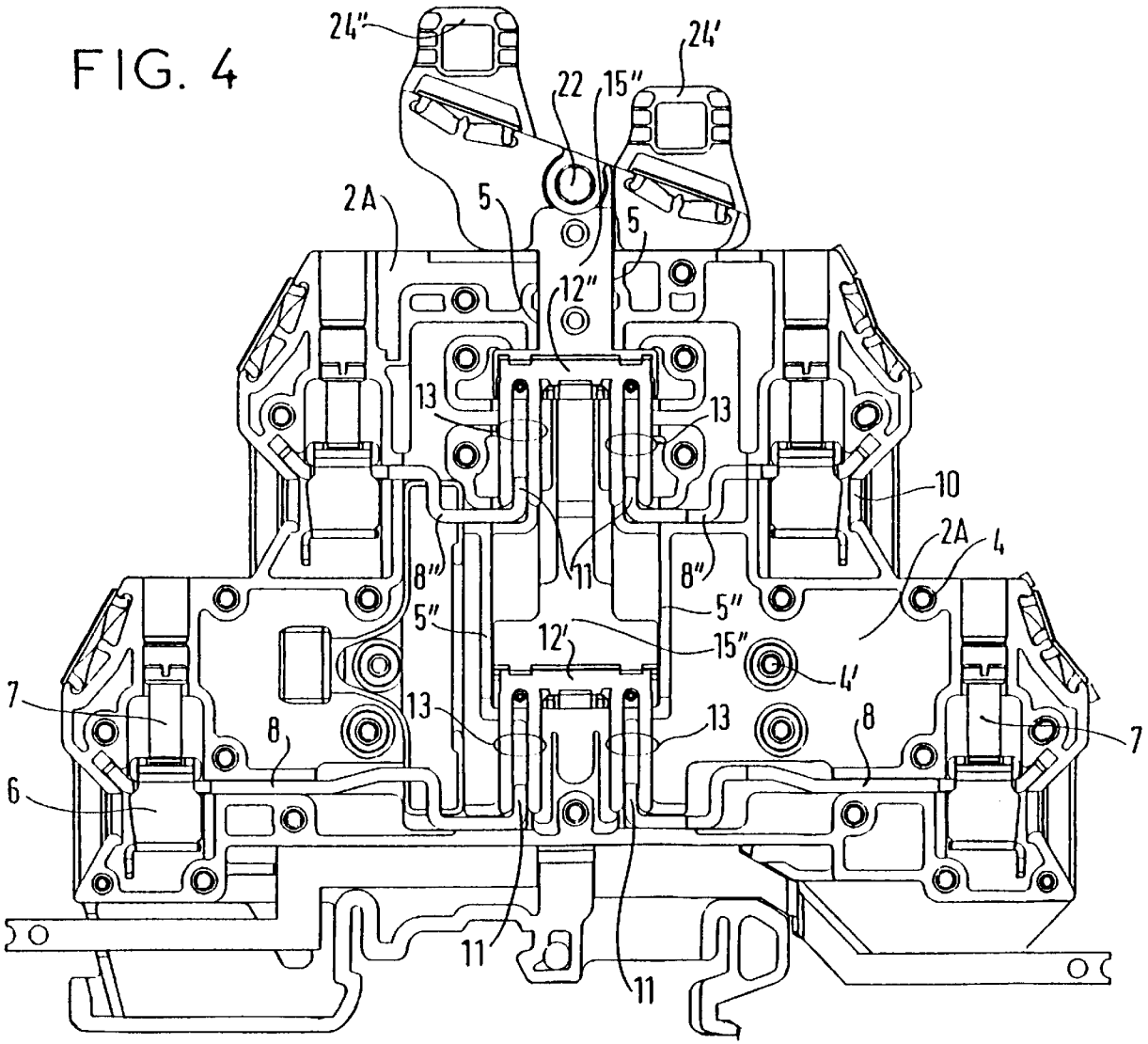
FIG. 4 is a side view of a variant embodiment of a connection module of the invention having two switches, the box of the module being identical to that shown in FIG. 1.
Figure 5:
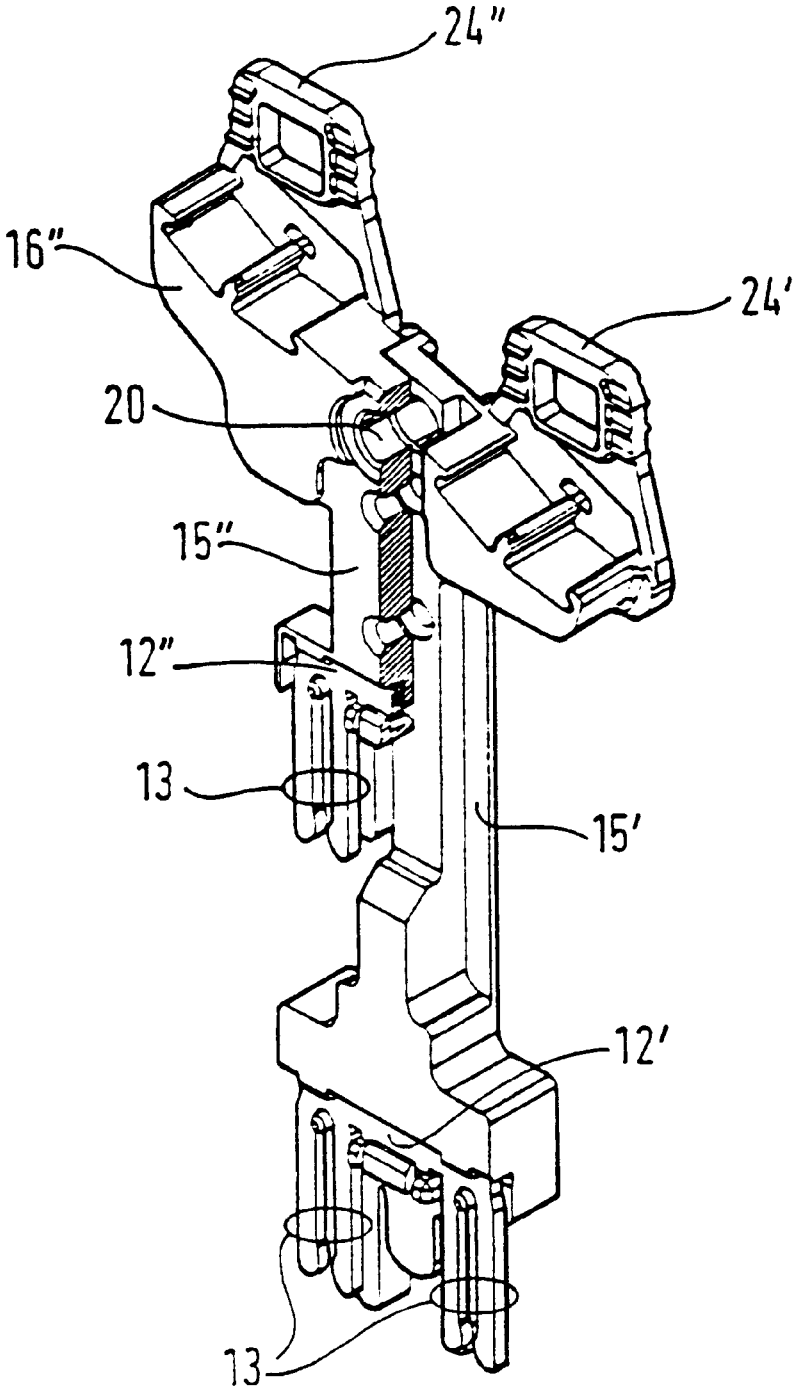
FIG. 5 is a perspective view, partially in section, of an example of a switch device having two switches, for the connection module of FIG. 4.
Figure 1:
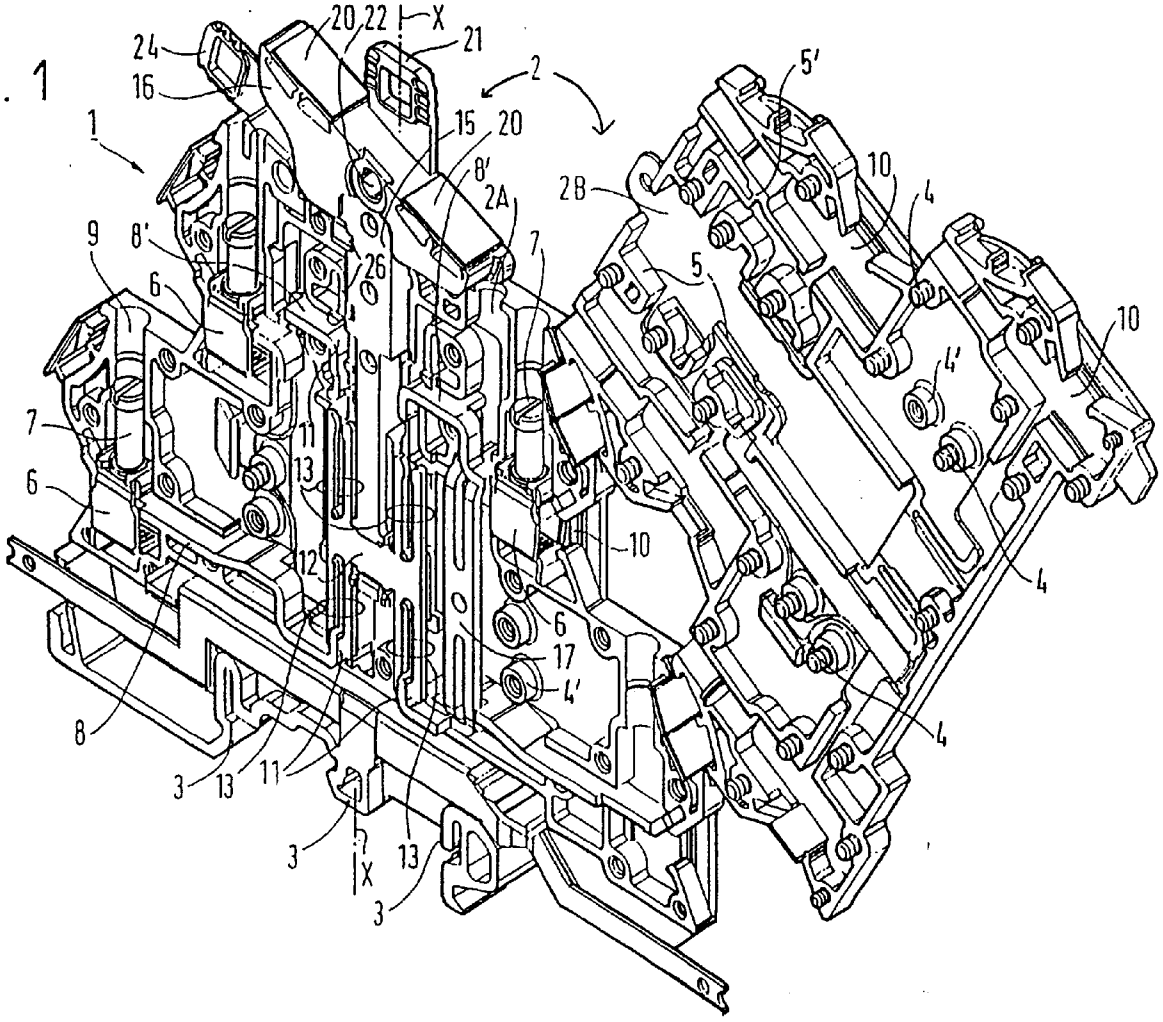
Figure 2:
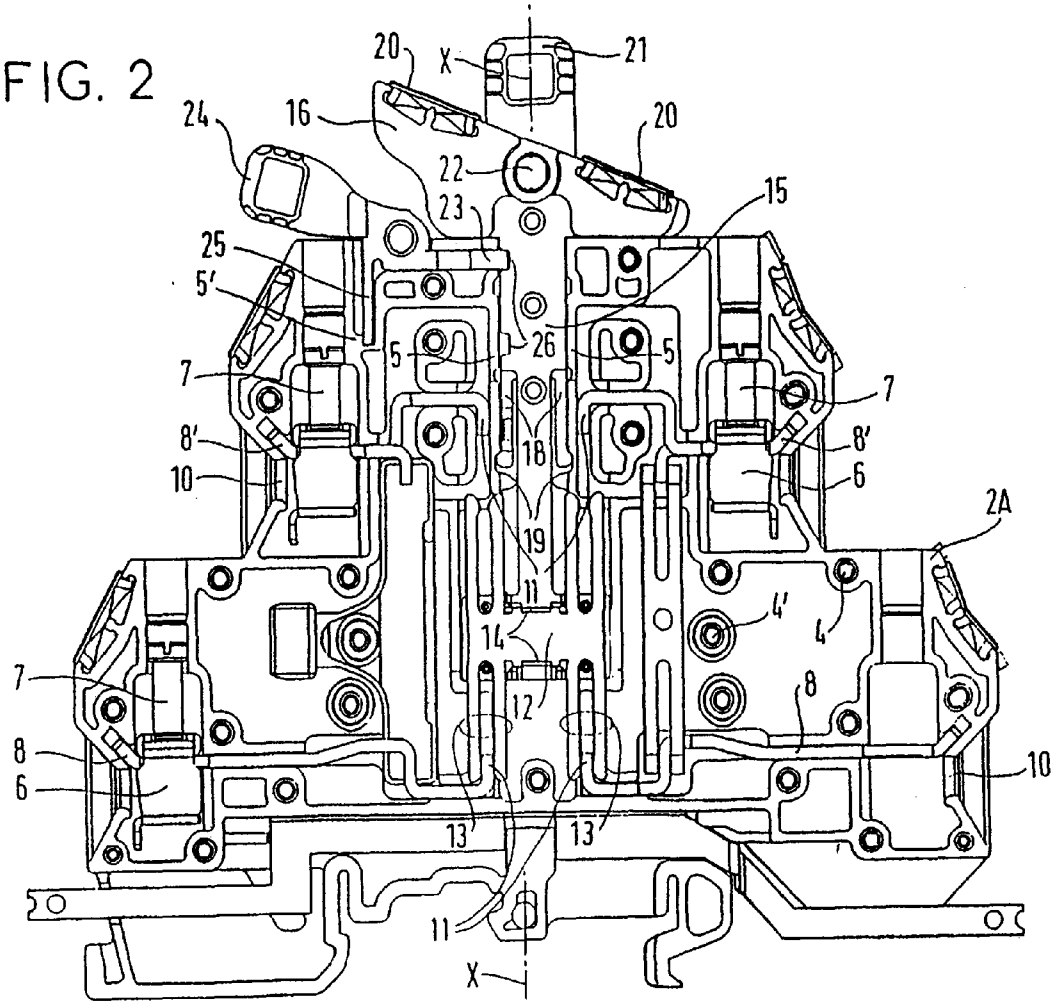
Figure 3:
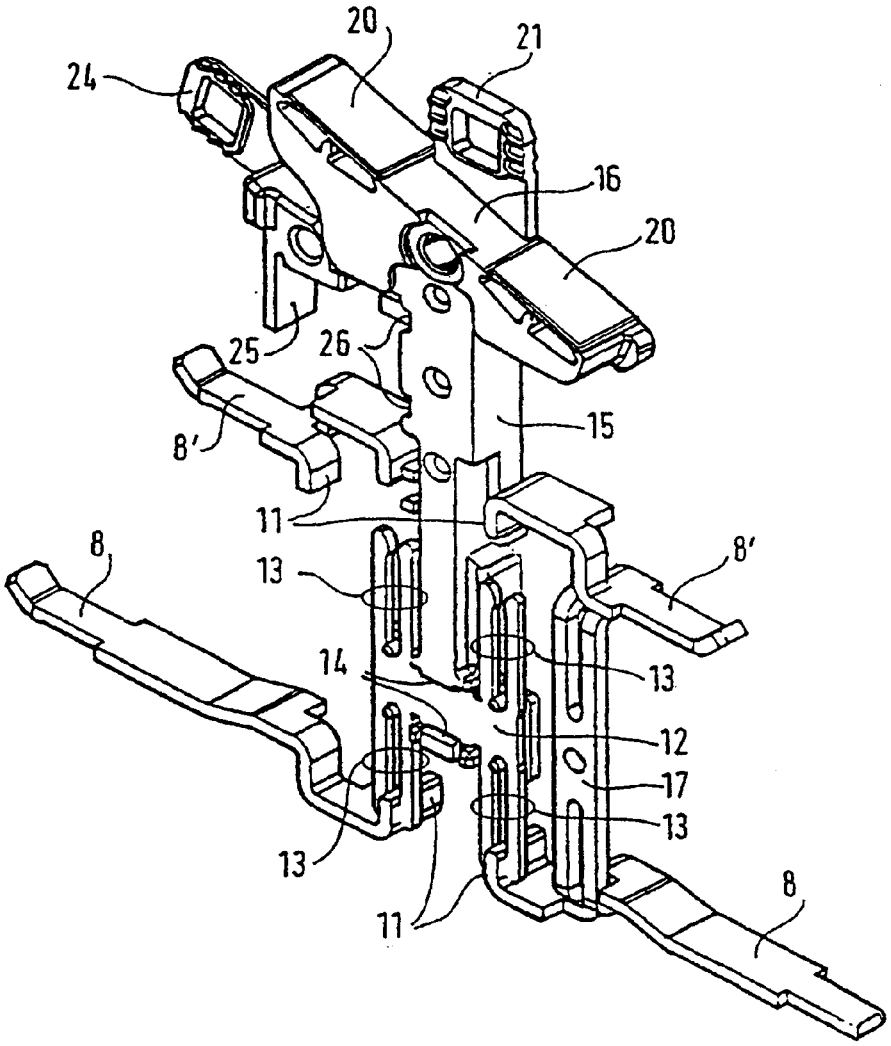
Figure 4:
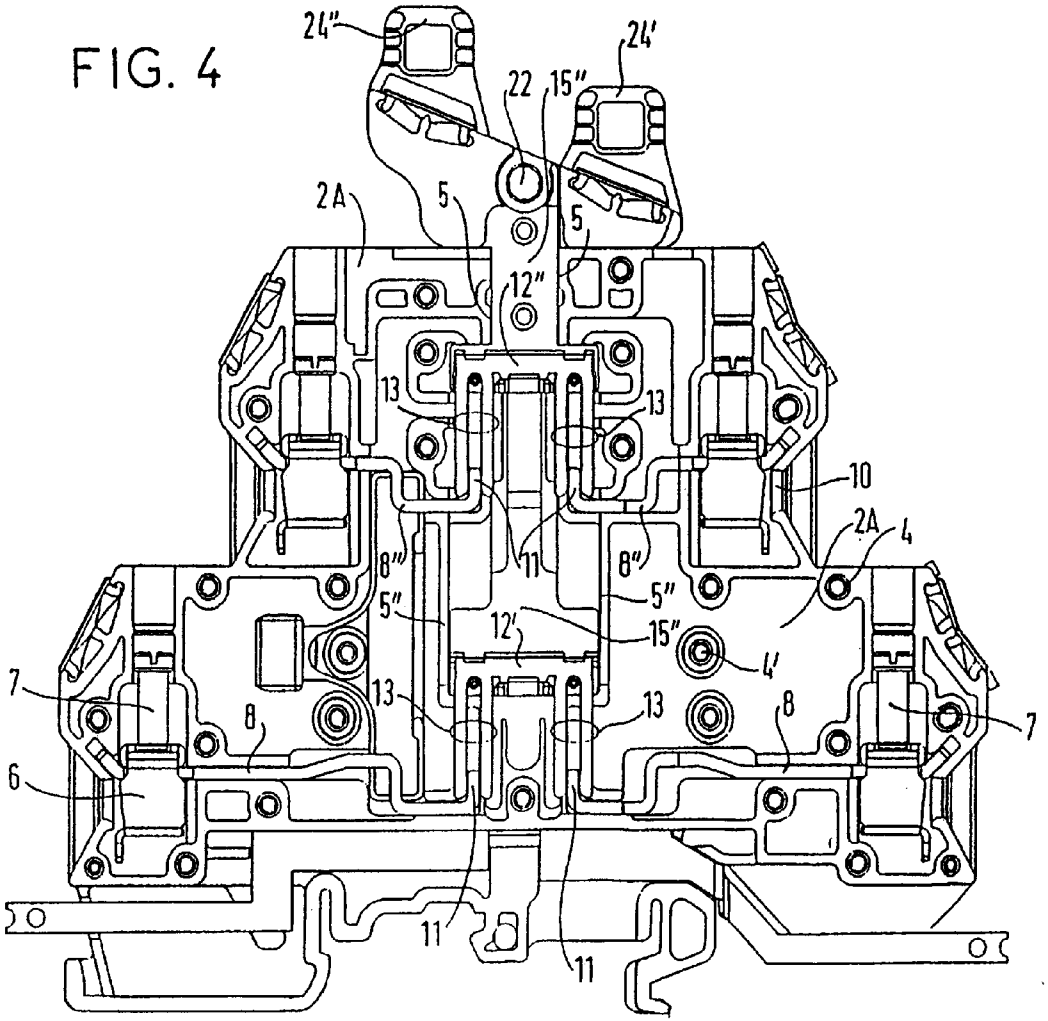
Figure 5:
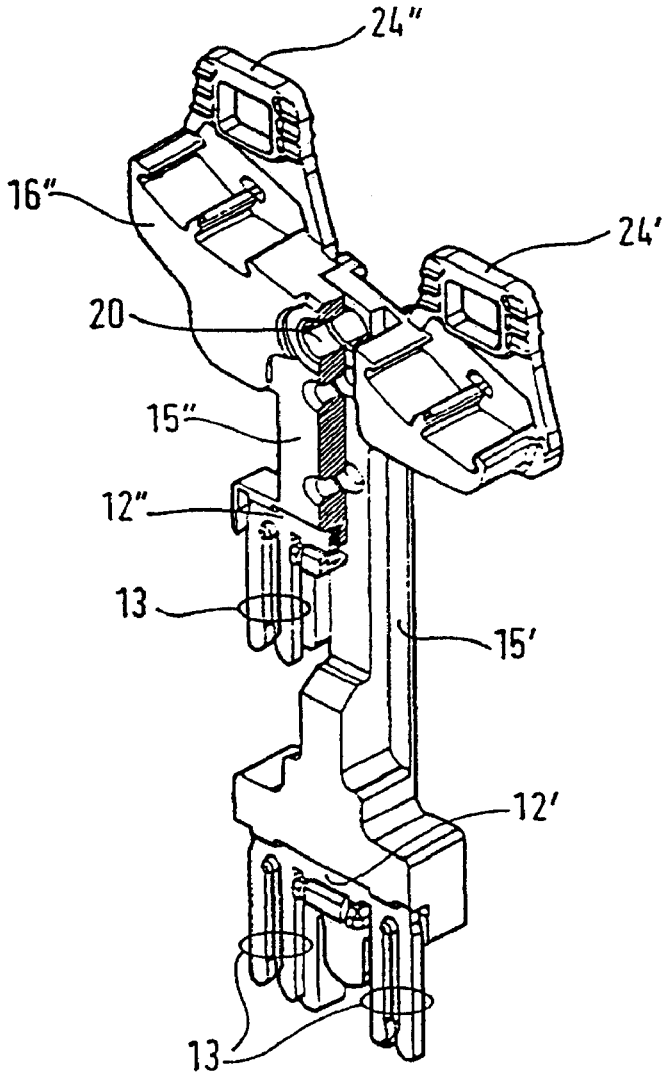

A variant of the connection module having two connection pieces and two electrical conductor switches as shown in FIGS. 4 and 5 is assumed to have a box that is identical to the box 2 described above, although that is not essential.

For reasons of convenience, elements that are identical in the embodiments shown in FIGS. 1 and 3 and in the embodiment shown in FIGS. 4 to 5 are given references that are identical and are not described again.

In this variant, provision is made for electrically interconnecting the two connection terminals on a given level by means of a moving conductive piece 12' or 12" that has only one comb, each of which comprises two clips 13, the two moving conductive pieces 12' and 12" being carried by different drive members 15' and 15".

By way of example, the conductive pieces 12' and 12" are obtained by cutting a conductive piece 12 in half, thereby separating the two combs which it comprises, with each comb separated in this way constituting one of the conductive pieces 12' and 12".

In the embodiment shown in FIGS. 4 and 5, the two connection pieces 12' and 12" have their clips oriented in the same direction, the connection piece 12' being designed to co-operate with the extensions 11 of the strips 8 situated in the connection module like the strips 8 in the module shown in FIG. 1.

The extensions 11 of the strips 8" in this example are oriented in the same direction as the extensions of the strips 8 in the connection module box, although the strips 8" are not of exactly the same configuration as the other strips 8 and 8', which are themselves also slightly different from each other.

Each of the connection pieces 12' and 12" is fixed via a positioning arrangement carried by a respective drive member 15' or 15", and the fixing can be done in a manner that is substantially the same as that used for fixing the connection piece 12 to the drive member 15.

Each of the drive members 15' and 15" comprises a sliding rod having one end carrying a handle-forming head 16' or 16" that remains projecting out from the module box whatever the displacement of the drive member in the box. The rods of the two drive members 15' and 15" are of different lengths in this case, as can be seen clearly in FIG. 5 where they are organized so that the connection pieces 12' and 12" are in alignment with each other inside the box, but can never touch.

The connection piece 12" is designed to move in rectilinear manner from a position where it is astride the projections 11 of the strips 8" to a position which is closer to the wall of the box that is remote from its base, so that the connection piece 12" is no longer in contact with the extensions. In similar manner, the connection piece 12' is designed to move from a position where it is astride the extensions 11 of the strips 8 to a position that is further away from the base of the box, where the comb is no longer in contact with the extensions.

In the embodiment shown, the connection pieces 12' and 12" are moved in rectilinear manner by causing the drive members 15' and 15" to slide relative to each other and relative to the guide elements 5 and 5" which define sliding grooves for the sliding rod elements of the two drive members. As already mentioned, the guide elements are carried on the inside face of at least one of the two box portions, once the portions are side by side to form a closed box. Thus, in the example described, the drive member 15' is guided at its end closer to the base of the box by guide elements 5" situated on either side of the end portion of said member carrying the connection piece 12', and against which said end portion slides. The two drive members 15' and 15" also slide relative to each other, and possibly together with the other between the guide elements 5 situated remote from the base of the box in the vicinity of the heads 16' and 16" of the drive members in the assembled connection module.

In the embodiment as shown in FIG. 5 in particular, the shorter drive member 15" is grooved lengthwise to its head 16" so as to receive a portion of the longer sliding rod of the drive member 15' and to allow the rods to slide independently, should that be required.

In this example, the heads 16' and 16" are offset from each other and also from the rods of the corresponding drive members. These heads are made in similar manner to the head 16 described above, and in particular they have handle-forming tabs 24' and 24". Each of them includes a duct portion 22 through which it is possible to interconnect the two drive members 15' and 15" by placing a common shaft of appropriate diameter simultaneously in the duct portions 22 of both drive members so as to make it possible for them to be moved simultaneously, should that be required, with identical or similar drive members of other connection modules beside them in the same alignment. If no such common shaft is fitted, then the two drive members make it possible to move each of the connection pieces independently.

We claim:

1. A connection module, in particular a junction block, comprising a box of insulating material containing connection terminals, a plurality of link strips, said connection terminals for electrical conductors that reach the link strips inside the box via insertion orifices formed through the walls of the box, said strips being stationary and extending towards a central portion of the box where each of them is terminated in individual extensions serving as contact elements, the extensions of the strips situated in pair at the same level in the box being interconnected by means of a moving conductive piece carried by a drive member operatable from outside the box, when said drive member is moved to slide inside the box to a position where the above-mentioned extensions of said pair of strips at the same level are individually engaged by respective spring-blade clips of the moving conductive piece, said module further including at least one conductive shunt piece having parallel spring-blade clips disposed in a comb, and said strip extensions that are folded to extend parallel to a common transverse midplane of the box, with said extensions at the same level extending in the same direction so as to enable them to co-operate with the clips of the conductive shunt piece and the moving conductive piece, each clip of the conductive shunt piece engaging the respective extension by coming astride it transversely and each clip of the moving conductive piece engaging the respective extension by coming astride it axially in a longitudinal midplane of the extension.

2. A connection module according to claim 1, including a locking device for locking a position of a portion of the drive member that forms a sliding rod, said locking device including a bolt-forming element inside the box and a pull tab outside the box carried by a resilient tab engaged in a groove of the box to enable a bolt to engage resiliently in at least one notch formed in the sliding rod, in the absence of traction being exerted on the pull tab.

3. A connection module according to claim 1, said moving conductive piece having clips disposed so as to form two combs mounted back to back, and said extensions serving as contact elements at a first level pointing in the opposite direction to contact elements at a second level so that at least two first level extensions are engaged by the clips of one of said combs in a first position reached by moving the drive member in one direction and at least two extensions of the second level are engaged by the clips of the other comb in a second position reached by moving the drive member in an opposite direction of said one direction.

4. A connection module according to claim 1, said extensions serving as same level contact elements disposed symmetrically about a plane parallel to which they extend, and said spring-blade clips of at least one said comb of said moving conductive piece disposed symmetrically about said plane and carried by said drive member that is movable in translation.

5. A connection module according to claim 1, at least one said drive member having one end constituting a handle-forming head which remains projecting from the box whatever the displacement of the drive member, and at least one positioning arrangement for positioning the moving conductive piece, each conductive piece moving inside the module box together with the portion of the drive member on which it is positioned, at least one said drive member including a portion that forms a sliding rod which is guided between guide elements included on the inside of the box, and which is provided with at least one resilient retaining element suitable for co-operating with at least one complementary element of the box to hold said drive member resiliently in at least one determined position until sufficient predetermined displacement force is applied to the drive member via the handle-forming head of said drive member.

6. A connection module according to claim 1, at least one said drive member provided with at least one positioning arrangement for the moving conductive piece situated at one of its ends, each moving conductive piece moving inside the module box with the portion of the drive member on which it is positioned, each drive member having a portion forming a sliding rod which is guided between internal guide elements of the box, the other end of each guide member including a handle-forming head which remains projecting outside the box whatever the position of the drive member of which it forms a part, and which includes a through duct for a rod for fixing together the handle-forming heads of a single module and/or of identical or similar modules that are in alignment.

7. A connection module according to claim 1, including at least two said moving conductive pieces each having at least one comb provided with parallel spring-blade clips for engaging said extensions serving as contact elements all pointing in the same direction on any one level, and with the extensions engaged by the clips of any one comb being on the same level, each moving conductive piece being carried by a different drive member, the two drive members sliding relative to each other and, optionally with each other, relative to common guide elements on the inside of the box.

8. A connection module according to claim 7, said extensions serving as contact elements situated on different levels and which are in alignment from one level to another, and said moving conductive pieces which are in alignment with each other and which carry said combs of identical orientations.

9. A connection module according to claim 7, said moving conductive pieces carried by respective said drive members movable in translation, one of which forms a sliding rod that is shorter than the other so as to enable the moving conductive pieces to be moved in translation in alignment with each other.

* * * * *

UNITED STATES PATENT AND TRADEMARK OFFICE

CERTIFICATE OF CORRECTION

PATENT NO. : 6,019,643
DATED : February 1, 2000
INVENTOR(S) : Sylvain Barrat et al.

It is certified that error appears in the above-identified patent and that said Letters Patent is hereby corrected as shown below:

Title page,
The title page, showing the illustrative figure should be deleted and substitute therefor the attached title page.

Drawings,
Sheets 1-5, consisting of Figures 1-5, should be deleted and substitute therefor the correct Figures 1-5, as shown on the attached pages.

Signed and Sealed this

Eighth Day of October, 2002

*Attest:*

*Attesting Officer*

JAMES E. ROGAN
*Director of the United States Patent and Trademark Office*

United States Patent [19]

Barrat et al.

[11] Patent Number: 6,019,643

[45] Date of Patent: Feb. 1, 2000

[54] CONNECTION MODULE HAVING CONNECTION TERMINALS THAT ARE INTERCONNECTABLE VIA AT LEAST ONE MOVING CONDUCTIVE PIECE

[75] Inventors: Sylvain Barrat; Francois Fayard, both of Villeurbanne; Bernard Bechaz, Caluire, all of France

[73] Assignee: Entrelac S.A., Villeurbanne, France

[21] Appl. No.: 08/990,640

[22] Filed: Dec. 15, 1997

[30] Foreign Application Priority Data

Dec. 16, 1996 [FR] France ..... 96 15414

[51] Int. Cl.[7] ..... H01R 9/26

[52] U.S. Cl. ..... 439/716; 439/709

[58] Field of Search ..... 439/716, 709, 439/712

[56] References Cited

U.S. PATENT DOCUMENTS

| | | | |
|---|---|---|---|
| 5,658,172 | 8/1997 | Schmidt et al. | 439/716 |
| 5,848,917 | 12/1998 | Bechaz et al. | 439/716 |

FOREIGN PATENT DOCUMENTS

| | | |
|---|---|---|
| 0386277 | 9/1990 | European Pat. Off. . |
| 2483692 | 5/1980 | France . |
| 2357080 | 1/1988 | France . |
| 1924454 | 9/1965 | Germany . |
| 2601849 | 7/1977 | Germany . |

*Primary Examiner*—Paula Bradley
*Assistant Examiner*—Tho Dac Ta
*Attorney, Agent, or Firm*—Ware, Fressola, Van Der Sluys & Adolphson LLP

[57] ABSTRACT

A connection module, in particular a junction block, having connection terminals that are interconnectable by means of moving conductive pieces that can be driven from outside the module. A box of insulating material contains the connection terminals and respective electric link strips for each module, which strips are fixed and terminate in individual extensions serving as contact elements, said extensions extending parallel to a common plane inside the box, with elements on any one level being in alignment. A conductive piece includes at least one comb of parallel spring-blade contact clips enabling it to come into contact with the extensions on a given level by the clips coming astride them when a drive member carrying the clips is moved inside the box from outside the box where said drive member has a handle-forming head.

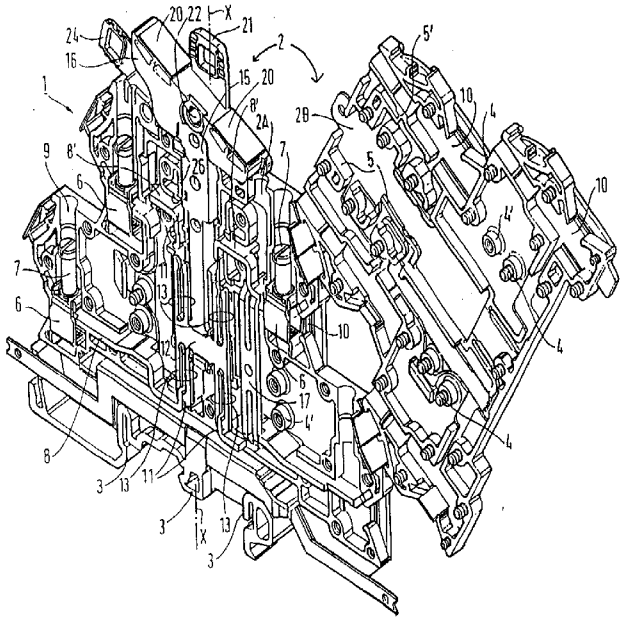

9 Claims, 5 Drawing Sheets